US006942335B2

(12) United States Patent
Trent

(10) Patent No.: US 6,942,335 B2
(45) Date of Patent: Sep. 13, 2005

(54) HAND HELD ELECTRONIC PAINT BRUSH

(76) Inventor: Jonathan Louis Trent, 20644 Chestnut Ridge Dr., Leonardtown, MD (US) 20650

( * ) Notice: Subject to any disclaimer, the term of this patent is extended or adjusted under 35 U.S.C. 154(b) by 0 days.

(21) Appl. No.: 10/216,975

(22) Filed: Aug. 12, 2002

(65) Prior Publication Data

US 2004/0027443 A1 Feb. 12, 2004

(51) Int. Cl.[7] ..... B41J 3/36
(52) U.S. Cl. ..... 347/109; 400/88; 346/143
(58) Field of Search ..... 347/109, 108, 347/101; 400/88; 434/84; 206/575, 223

(56) References Cited

U.S. PATENT DOCUMENTS

| | | | | | |
|---|---|---|---|---|---|
| 4,696,400 | A | * | 9/1987 | Warman | 206/575 |
| 4,947,262 | A | * | 8/1990 | Yajima et al. | 358/296 |
| 4,999,016 | A | * | 3/1991 | Suzuki et al. | 400/88 |
| 5,063,451 | A | * | 11/1991 | Yanagisawa et al. | 346/143 |
| 5,593,236 | A | * | 1/1997 | Bobry | 400/88 |
| 5,595,445 | A | * | 1/1997 | Bobry | 400/88 |
| 5,650,820 | A | * | 7/1997 | Sekine et al. | 347/263 |
| 5,887,992 | A | * | 3/1999 | Yamanashi | 400/88 |
| 5,892,523 | A | * | 4/1999 | Tanaka et al. | 347/3 |
| 5,988,900 | A | * | 11/1999 | Bobry | 400/88 |
| 6,092,941 | A | * | 7/2000 | Imai | 400/88 |
| 6,217,336 | B1 | * | 4/2001 | Matthews | 434/84 |
| 6,229,565 | B1 | * | 5/2001 | Bobry | 348/207.99 |
| 6,312,124 | B1 | * | 11/2001 | Desormeaux | 347/109 |
| 6,517,266 | B2 | * | 2/2003 | Saund | 400/88 |
| 6,648,528 | B2 | * | 11/2003 | Hardisty et al. | 400/323 |
| 6,719,467 | B2 | * | 4/2004 | Hess et al. | 400/76 |
| 2002/0154186 | A1 | * | 10/2002 | Matsumoto | 347/14 |

FOREIGN PATENT DOCUMENTS

| | | | | |
|---|---|---|---|---|
| DE | 3314041 | A1 | * 10/1984 | B41J/3/28 |
| FR | 2592337 | A1 | * 7/1987 | B41J/2/01 |
| GB | 2078616 | A | * 1/1982 | B41J/3/36 |
| JP | 61064469 | A | * 4/1986 | B41J/3/28 |
| WO | WO 9216375 | A1 | * 10/1992 | B41J/3/26 |

OTHER PUBLICATIONS

Merriam–Webster's Collegiate Dictionary Tenth Edition; triangulation; p. 1256.*

* cited by examiner

*Primary Examiner*—Manish Shah
*Assistant Examiner*—Leonard Liang

(57) ABSTRACT

A hand held device that accepts a digital image, and transfers it to a wall, ceiling, floor, or any smooth surface. The hand held unit consists of a print element array in addition to a positioning mechanism that determines the absolute position of said device on the wall. Said positioning mechanism consists of a plurality of extruding tape, which in conjunction with the motion of the device over the surface, provides linear measurements from a plurality of fixed reference points to a fixed location on the device. The combination of said tapes provide sufficient information to triangulate the exact location and orientation of said device on the surface, subsequently providing sufficient information to impart the proper portion of said digital image to the surface, as said device moves across the surface. Repeated sweeping movements of said device over the surface will render further portions of the image, until it is complete.

11 Claims, 6 Drawing Sheets

HAND HELD ELECTRONIC PAINT BRUSH

CROSS-REFERENCE TO RELATED APPLICATIONS

Not applicable.

FEDERALLY SPONSORED RESEARCH

Not applicable.

SEQUENCE LISTING OR PROGRAM

Not applicable.

BACKGROUND

1. Field of the Invention

This invention relates to a hand held electronic device that imparts a digital image onto a wall, ceiling, floor, or any smooth relatively flat surface. Related U.S. Patent Classification Definitions include Nos. 347/109, 400/88, 434/84, and 206/575.

2. Description of Prior Art

When decorating a room, there are many products available to enhance the aesthetic appeal of the space. A portion of this décor involves the walls, ceilings, and floors, of which there are many treatments and dressings available. Typical decor involves paint, wallpaper, and wall borders, materials that are readily available, but for more sophisticated treatments, such as murals, trompe l'oeils, borders, faux surfaces such as marble, faux mosaics, and many other pleasing effects, a professional artist is typically required. One can tackle the task themselves, although this comes with it a large burden to not only design the imagery itself, but to also proportion the design on the surface, acquire the appropriate paints, layout the outlines of the design on the surface, put down drop clothes, and meticulously apply the paint, layer by layer, color by color.

A couple alternatives to this approach have been proposed in U.S. Pat. Nos. 4,696,400 and 6,217,336. Although both provide patterns as guides for the non-professional artist, the patents rely on the consumer applying the pattern to the surface, having the necessary paints, and most importantly of all, a fine artistic eye for detail, color and light, particularly for sophisticated wall art.

Furthermore, on the supply side of providing wall art, a professional artist is somewhat limited in their ability to expand their clientele due to their physical presence being required in the room to be decorated. That is, they have to be present to render their art. Per the prior art references, reducing their art to patterns provides an avenue for the artist to distribute their work to a wider audience without being physically present, but the range of color and light in the imagery must be limited to accommodate the non-artist who will be applying the art. This stifles the entry of truly professional artists in the realm of mass distribution of full-scale sophisticated wall designs for the home or office.

From a technical perspective, a few alternatives to applying ink to surfaces via hand held devices are U.S. Pat. Nos. 4,947,262, 5,595,445, 5,887,992, 5,988,900, and 6,092,941. These offerings, though, are generally limited to linear printing of text, symbols, indicia, bar codes, and the like. An offering that begins to approach the present invention is U.S. Pat. No. 6,312,124, which is a hand held device proposing to impart images on various surfaces, but again, its basic concept involves generally a single stroke, and thus lacks the ability to render large, coordinated imagery, such as would fill a wall.

OBJECTS AND ADVANTAGES

The present invention provides significant advantages over current practice, by simplifying the application of even sophisticated designs and images to a wall, ceiling, floor, or any smooth surface.

1. The primary advantage of the present invention is that it greatly reduces the artistic skill required to render murals, tromp l'oeils, borders, faux surfaces, patterns, faux mosaics, and any other imaging that can be applied to a wall, ceiling, floor, or any smooth relatively flat surface that will accept the coloration.
2. Broadens the market for professional artists to digitally master imagery and distribute it to those with little artistic skill to render. Thus, the artist does not need to be physically present at the time of the application of the image to the surface, as a non-artist operator of the present invention can render a faithful copy of the art.
3. Allows an operator to take simple artistic elements, and combine them into a more complex scheme by allowing for a gallery of art components. For instance, the artist might have a series of banisters that are used throughout a mural. Designing a single banister and then replicating the image on the wall via the current invention speeds the work.
4. The source of the digital image doesn't necessarily have to be a professional artist either. With readily available sources of digital images via commercially available digital cameras, scanners, or for that matter, images from the internet, a user of the present invention can impart their own images on the wall. For instance, a digital image of ones child could be placed on the wall outside their room.
5. Makes use of coloring mixing techniques to generate a multitude of colors, thereby eliminating the need to buy many variations of paint, or having to meticulously mix paint for the desired color.
6. For imagery requiring perspective, commercially available software can be used to assist in taking a rendered model, and adjusting the perspective. For instance, a banister to be used on a ceiling can be drawn naturally, and then skewed by software to appear to draw to a distant point in the center of the ceiling, in addition to light effects being applied to make the rendered image appear three dimensional. Stretching and sizing of the imaged to be applied to the surface is also possible.
7. Eliminates the need to prepare the wall with stencils and there is no need for drop cloths, or other major protection when rendering images.

SUMMARY

To accomplish the foregoing objectives, the present invention consists of a hand held electronic device, simplifying the delivery of a plurality of decorative finishes on a wall, ceiling, floor or any smooth relatively flat surface (here forward referred to as "wall"), such as murals, trompe l'oeils, faux mosaics, faux friezes, and other faux finishes such as marble, wood grain, and stone to name a few (here forward referred to as "mural"). In the current embodiment, the device accepts a digital image from a computer, and the operator, after identifying the location on the wall to impart the image, manually sweeps the device over the surface of the wall. This sweeping motion only imparts a swath of the image the width of the print element array, so the operator will continually sweep the device across the wall until the complete image has been rendered. In order for the device to render a swath of the image, it must know where on the wall the print element array currently resides, so that it can determine what pixels of the image will be applied. Said device consists of a component to ascertain its absolute position on the wall, allowing it to determine the portion of the image to be applied.

1. The device is essentially in the class of computer peripherals, and in the current embodiment, accepts a digital image from a computer. This does not preclude future means of accepting images, for instance, from cartridges or memory sticks.
2. The device has a Central Processing Unit (CPU) and Random Access Memory (RAM) component, which assist in accepting the image from the computer.
3. The device has a positioning component, which determines the device's absolute location and orientation on the wall accepting the image. This component, in conjunction with the image itself, is used by the CPU to determine the portion of the image to be applied to the wall.
4. The device has a print head, consisting of an array of print elements, controlled by the CPU, which generate the pixels of the image on the wall as the device is manually swept across the wall.

DRAWINGS

A device to render digital images to a wall will now be described by way of example with reference to the accompanying diagrammatic drawings in which.

DETAILED DESCRIPTION OF A PREFERRED EMBODIMENT

For ease of discussion, the surface accepting the digital image will be referred to as the "wall", and the rendered image will be referred to as the "mural". Per the summary of said invention, the device has a multitude of uses beyond walls and murals.

Figure 1:
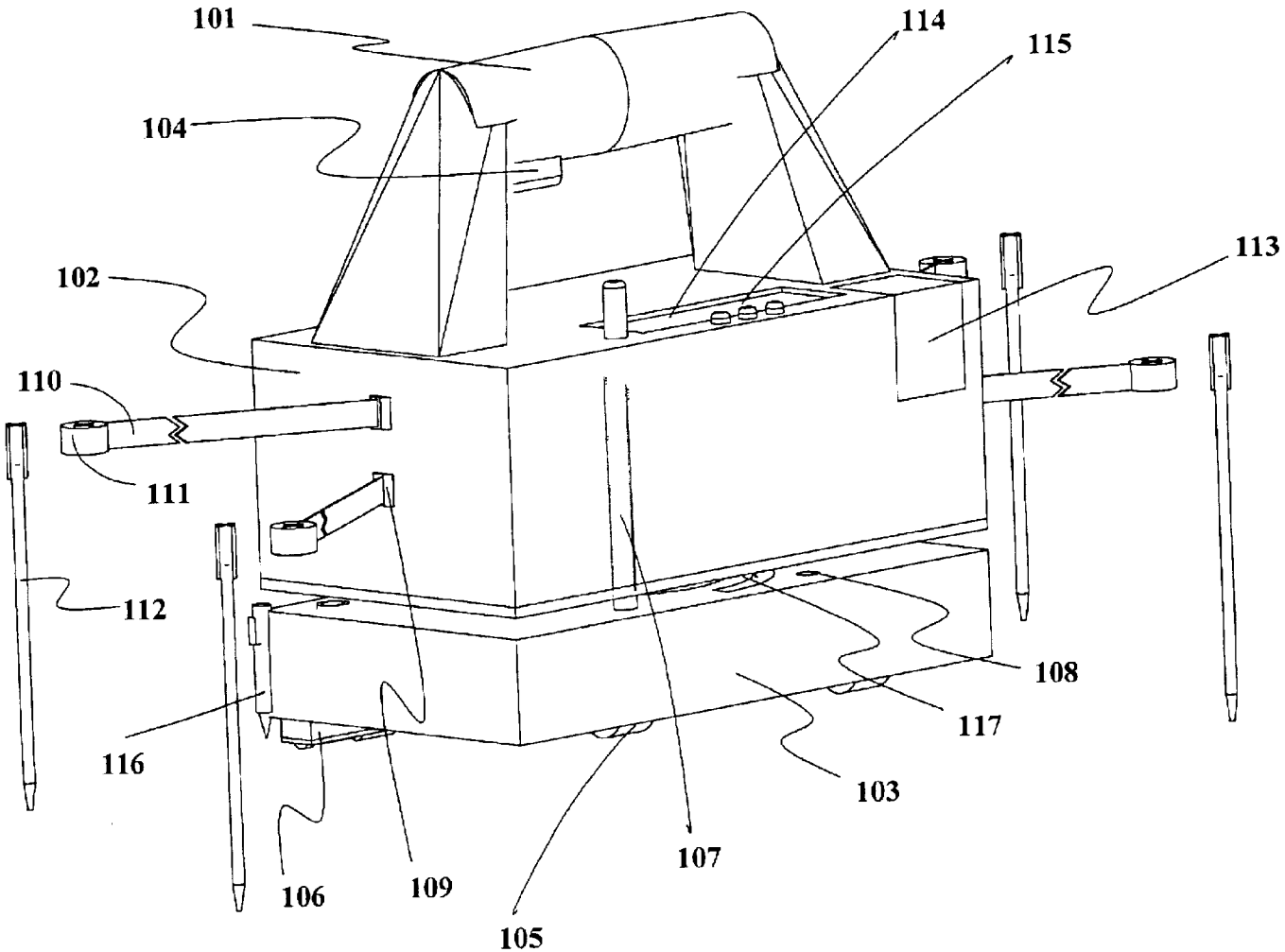
FIG. 1 is an embodiment of the device.

The device shown in FIG. 1 is intended for home or professional use by those with little or no artistic skill to render professional images onto a wall. The skill required is commensurate to printing computer images, such as those created in drawing programs or via a digital camera, and operating a computer peripheral.

As shown in FIG. 1, the device is encased in a housing, which protects its innards, and provides for an ergonomic feel. The current embodiment consists of a handgrip 101 attached to the upper housing 102, to provide the operator with a means of moving the device across the wall. An alternate embodiment would be the implementation of a palm grip as part of the upper housing, which eliminates the need for a handgrip, and creates a smaller footprint. For any embodiment of said device, there must be some ergonomic means for the operator to manually move the device over the wall. The underside of the lower housing 103 has rollers 105 to allow it to freely move over the wall. A trigger 104 is ergonomically placed for the operator to press when it is desired to impart the image to the wall as the device is swept across the wall. As the device is moved across the wall, the image is applied via the print element array attached to the color wells 106, contained in a replaceable cartridge. This cartridge contains the necessary coloration to impart the spectrum of colors. To accommodate inside corners and edges of the wall, the device allows the lower housing 103 to be rotated in increments of ninety degrees in relation to the upper housing 102. This is controlled by the pin 107 in the upper housing, which locks the upper and lower housings via the plurality of pin holes 108 in the lower housing. Should the operator need to rotate the device, the pin 107 is pulled up, and the lower housing rotated until the pin drops into one of the pin holes 108. A sensor at the bottom of the pin hole detects the new postion of the lower housing relative to the upper housing, and adjusts the calculations of the location of the print elements with respect to the positioning component in the upper housing.

The said device has a positioning component in the upper housing 102, the function of which is to provide sensory input to the CPU regarding the current position of the device on the wall. Thus, as the operator moves the device over the wall, the positioning component is constantly providing the CPU with specific location information, sufficient for the CPU to in turn, transfer the corresponding part of the image to the wall. There are a number of ways of implementing the positioning unit. These include using sonar or laser positioning devices, which make use of a fixed reflective surface to provide data on the distance of the device from said reflective surface. The critical issue, though, with the positioning component is that it must support a high enough sampling rate to allow the user to move the device at a comfortable rate, without the image being distorted on the wall due to latency between receiving the positioning data, determining the part of the image to be rendered, and actually rendering the coloration. Also, the resolution of the positioning function is in direct proportion to the maximum allowable resolution of the transferred image. For instance, if the positioning function can only provide readings to 0.02 inch, then the resolution of the image can be no denser than 50 pixels or droplets per inch.

In the current embodiment of said device, the positioning component makes use of a plurality of tapes 110 extruding from the upper housing. At the end of each tape is a reference connector 111, which allows the tape 110 to be attached to a reference stake 112 that has been fixed to the wall. There is a pair of upper housing tape guides 109 that assist in guiding the tape as it extrudes and retracts as a result of sweeping the device across the wall. Although this embodiment has the disadvantage of having tapes 110 extruding from the device, there are three distinct advantages that outweigh this. First, the tape embodiment of the positioning component takes advantage of readily affordable commercially available components, and provides for resolutions in excess of 0.0025 inches. Second, the sampling rate is very high. Third, for gently curved walls, such as outwardly curved walls or arched ceilings, the tape can flex with the concave curve or provide a straight reading with a convex curve, whereas a method such as sonar or laser reflection will require a much larger fixed reflective surface to provide accurate readings.

The said device has a means of accepting the digital image, in this particular embodiment, via an optical link 113. Other embodiments could include a radio frequency link, an acoustic link, or a physical cable link such as a parallel port. To assist the operator in using the device, a liquid crystal display (LCD) 114 and a plurality of control buttons 115 are provided.

One other component of note is the pin site 116, attached to the lower housing 103. The pin site 116 allows the operator to slide the pin down to the wall, to assist in identifying a location on the wall. It is the combined action of the operator identifying the location on the wall with the pin site 116 and pressing the trigger 104, that provides the device with the necessary information to record a significant location on the wall. For instance, if the operator is to identify the placement of an image on the wall via two opposing corners, this is accomplished by moving the device over the wall to align the pin site 116 with one corner where the image is to be rendered, and pressing the trigger, and then moving the device and aligning the pin site 116 with the other corner and pressing the trigger.

The Imaging Component

Figure 2:
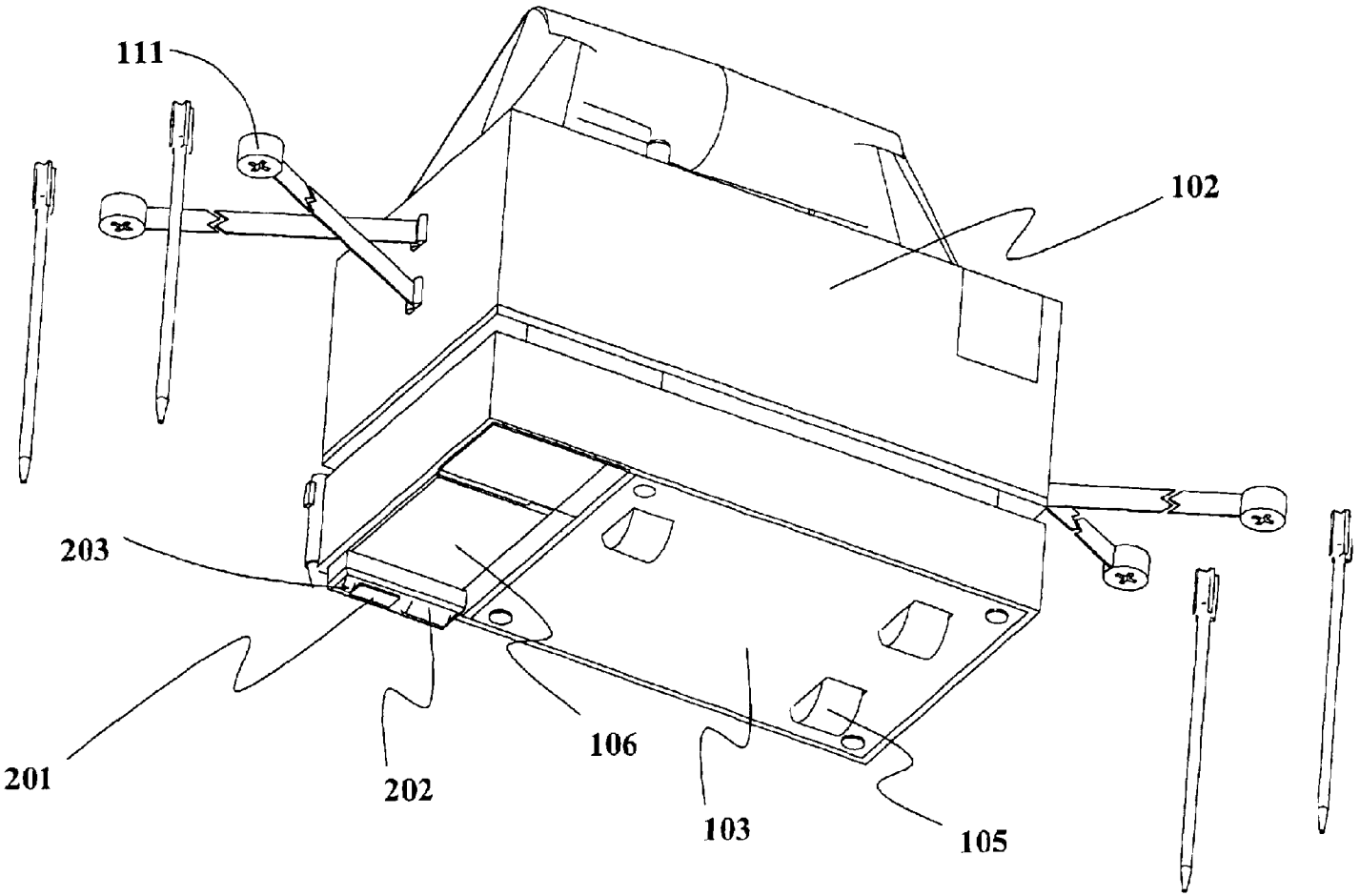
FIG. 2 is a view of the bottom of the device.

FIG. 2 shows the underside of the device, providing a view of the upper 102 and lower 103 housings. The lower housing 203 has a plurality of rollers 105 that allow the unit to glide over the surface of the wall. The color well cartridge is attached to the lower housing 106, along with the print element array 201. In the current embodiment, the color wells 106 and print element array 201 consist of ink and an ink jet nozzle array, respectively. This does not preclude other types of coloration or printing techniques, such as thermal printing, from being used in other embodiments of this invention.

In the current embodiment, the print element array 201 has rollers 202 203 on either side of it. The outside roller 203 is slightly recessed so that it acts more as a safe guard for the print element array 201 from scraping the wall, while the inside roller 202 is expected to contact the wall much like the other rollers 105 of the lower housing 103. By being slightly recessed, the outside roller 203 will not contact the wall with proper downward tension, thereby preventing it 203 from rolling through the previous swath, which might not be dry yet. These rollers 202 203 serve to both protect the print element array 201, and also to ensure a consistent distance between the print element array 201 and the wall. Furthermore, the color well cartridge 106 has some downward tension to ensure that the print head is in contact with the surface. In other embodiments, this downward tension of the color well cartridge can be sensed, and used to determine whether the print element array 201 is in contact with the surface before any coloration is dispensed. This will prevent the operator from inadvertently dispensing coloration when the print element array 201 is not in contact with the surface.

The print element 201 array is perpendicular to the motion dictated by the rollers 105 under the lower housing 103, allowing for the widest possible printing swath, thereby minimizing the total number of strokes required by the operator to render the image on the wall. The rollers 105, including those on either side of the print element array 202 203 are non-marring, as they will be in contact with the wall. In the current embodiment, the rollers 105 are allowed to roll freely, but this does not prohibit using the rollers 105 to govern the speed with which the operator moves the device over the surface, should the performance of the printing mechanism warrant it. Additionally, other embodiments of this invention could use the rollers 105 to assist in providing sensor input as to the rate of linear movement over the wall.

To cover the spectrum of colors, the color well cartridge 106 consists of the three primary or secondary colors, along with black and white. This minimizes the plurality of color wells, yet ensures a broad range of coloration to form the image. Other combinations of colors are possible, of course, and could be used in cases where the overall image being rendered has a slant towards a specialized hue.

Another noteworthy point regarding the print element array 201 is its placement relative to the overall footprint of the device. In the current embodiment, the print head is in as extreme corner of the device as possible, to allow the image to be rendered as close to an inside corner or edge of a wall as possible. On outward appearances, this looks to only accommodate one inner corner of the wall, but the lower housing 103 swivels in ninety degree increments, up to two hundred seventy degrees, allowing the print element array 201 to reach the other three inner corners of the wall as best as possible. Note that the handgrip 101 and the extruding tape 110 retain their original position. It is simply the lower housing 103 that swivels. The astute artisan will observe that a rectangular footprint of the housing 102 103, when looking from below or above, only provides tight coverage into inner edges of a wall when the lower housing 103 is zero and one hundred eighty degrees in relation to the upper housing 102. At ninety and two hundred seventy degrees, the upper housing 102 appears to butt out, preventing the lower housing 103, and thus the print element array 106, from getting as close as possible to the inner corner or edge of the wall. With crown and floor molding, this is not an issue, as the mural will not need to get very close to the inner edges of the wall. But to minimize this, consideration should be given to as square a footprint of the housing 102 103 as possible, when looking from below or above, thereby preventing this phenomenon.

Exploded View of the Device

Figure 3:
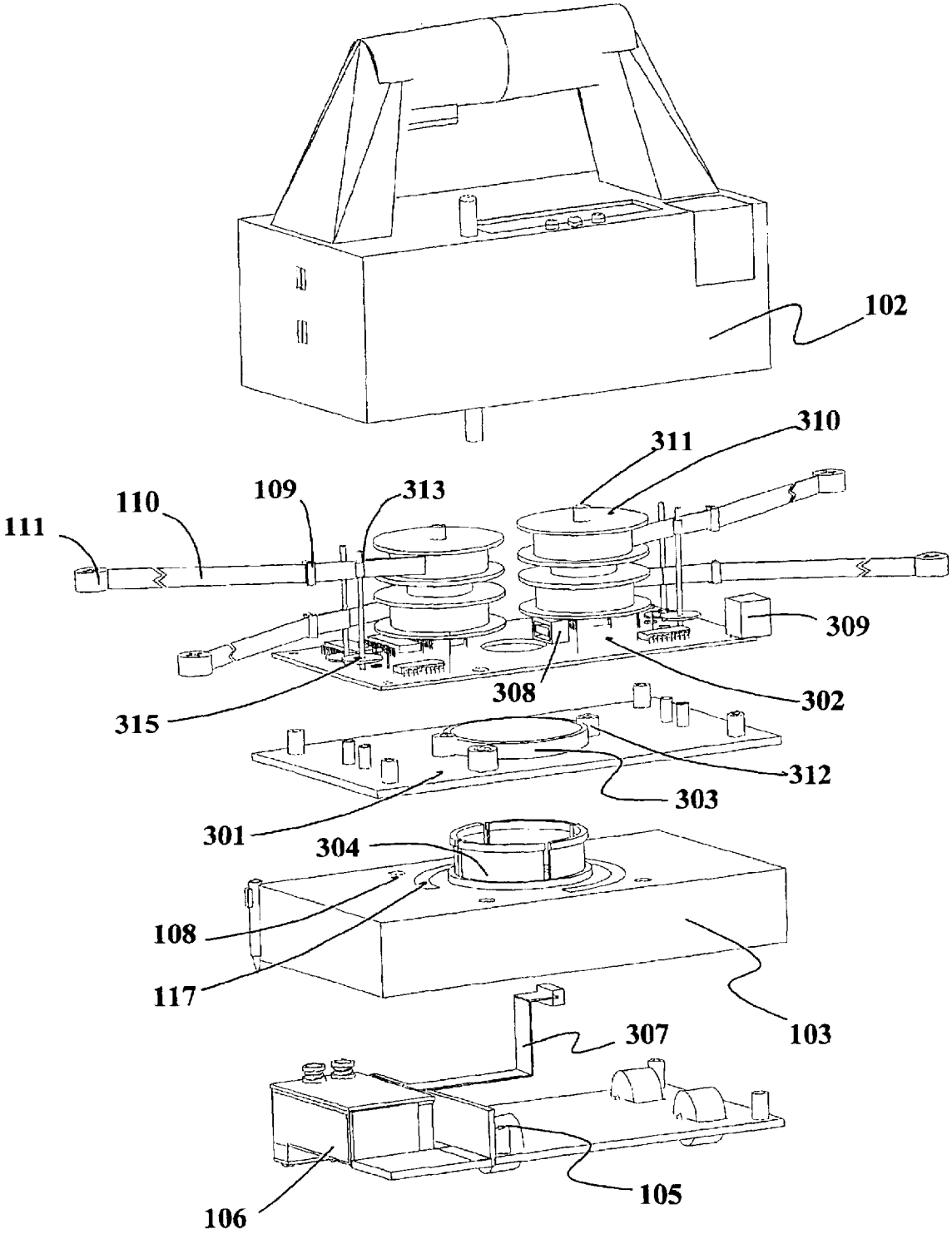
FIG. 3 is an exploded view of the device with the housing removed.

FIG. 3 is an exploded view of the device, showing its innards. In this view, the upper housing 102 has been removed from the bottom of the upper housing 301, revealing a circuit board 302. The lower housing 103 is attached to the upper housing by snapping the lower housing collar 304 into the upper housing collar 303. This circular connection allows for the upper housing 102 and lower housing 103 to rotate relative to each other. Note also that the cavity of the lower housing collar 304 allows any connecting cables 307 to pass from the lower housing 103 components to the appropriate connectors 308 on the circuit board 302 in the upper housing 102. To prevent the cables from being twisted too far, a groove 117 with a corresponding peg that protrudes from the bottom of the upper housing 301, prevents the upper housing 102 and lower housing 103 from spinning more than two hundred seventy degrees relative to each other.

The Circuit Board

The circuit board 302 contains the Central Processing Unit (CPU), Read Only Memory (ROM), Erasable Programmable Read Only Memory (EPROM), and Random Access Memory (RAM) provide the brains of the device. During startup, the CPU starts execution from the ROM, which initializes the electronics of the device, and initiates the system software from the EPROM. The system software is stored in the EPROM in the event that there are future system software updates. The system software is executed by the CPU, and guides the use of the sensor data and system components to coordinate the functions of the device.

The system software provides instructions to the operator via an LCD 114, providing instructions and feedback to the operator during the use of the device.

The system software accepts the image to be applied to the wall from a computer, and stores the image in RAM. Should the image exceed the available memory, it is paged, and rendered piecemeal on the wall. The means by which the image is communicated to the device can be done any number of ways. In the current embodiment, this is done by means of an infrared link 113, to eliminate a dangling communication cable while the device is in use. Thus, other optimal embodiments of communication between a computer and the device include radio frequency or acoustic links.

The system software provides further instructions via the LCD 114 to the operator, to identify the working area of the image. The operator identifies the plurality of reference points on the wall where the image is to be applied. This provides the operator with the means of repeating an image on the wall. A more sophisticated approach is to define an image with critical points, which can then be defined on the wall, with the image being transformed to fit the defined critical points.

Figure 5:
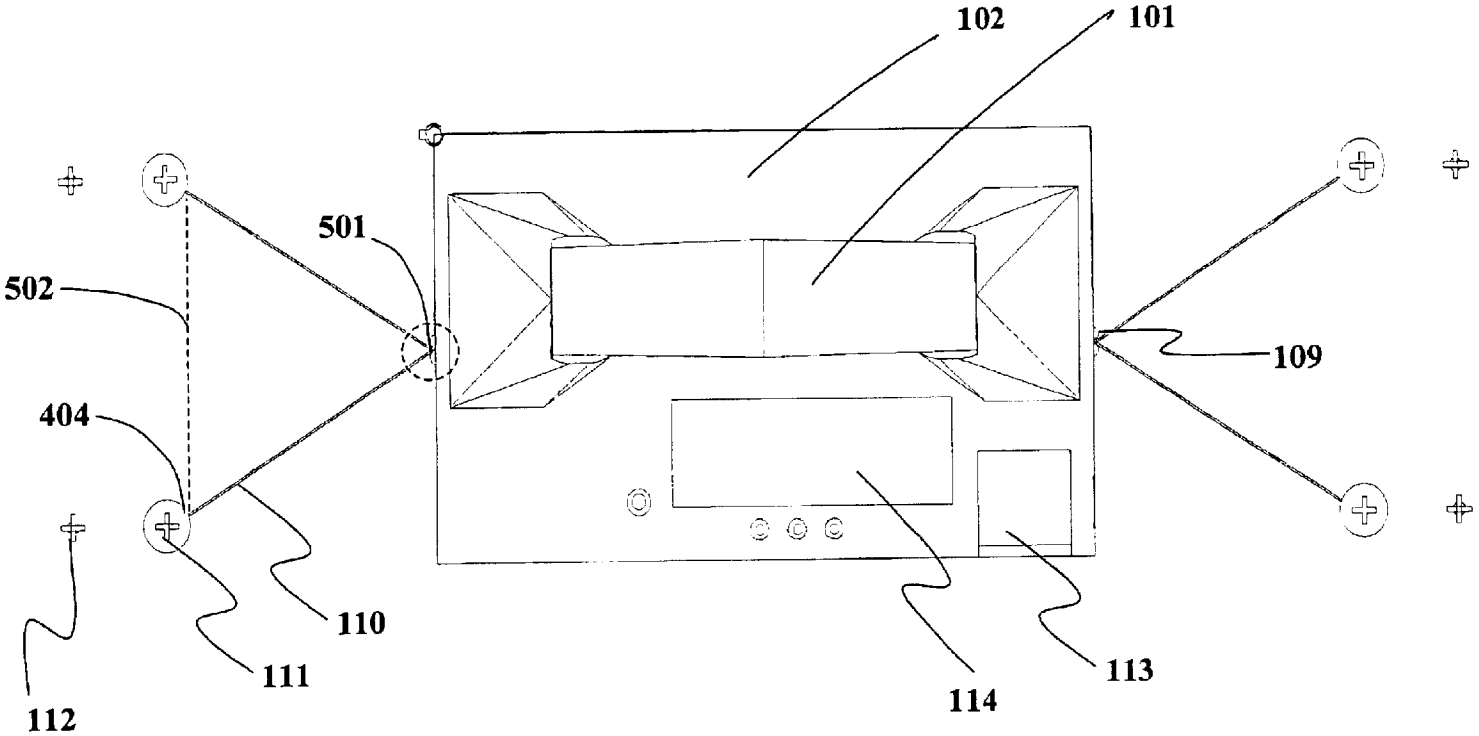
FIG. 5 is a top view of the device illustrating the use of triangulation to resolve the absolute position of the device with respect to the surface accepting the image.

The system software determines the pixels of the image to print through the positioning mechanism, which makes use of triangulation and known parameters of the device itself. Per FIG. 5, when looking at the current embodiment of the device setup from the top, it becomes apparent that the two sets of extruding tape 110 form triangles. The lengths of the tape 110 and the distance 502 between fixed reference points 404 are known quantities at any given moment, so the system software can calculate the precise location of the intersection point 501 of the extruding tape 110. This holds for the plurality of extruding tapes, and for further assurance, the system software ensures that the distance between the plurality of intersecting points 501 is constant. If not, then one or more of the extruding tapes 110 is providing a false measurement.

Back to FIG. 3, the system software determines if the user is pressing the trigger 104, and if the print element array 201 is over a portion of the wall that is yet to have the image rendered. If so, a portion of the image is rendered according to its digital representation, and then marked as being rendered, so that subsequent passes by the device do not re-print that portion of the image.

The device must have a source of power to drive the circuitry and the application of the image to the wall. The current embodiment makes use of a battery pack in the lower housing 103, which is recharged through the use of the low voltage power cable attached to the power inlet 309. The battery pack eliminates a dangling power cable while the device is in use.

The Positioning Component

Above the circuit board are tape reels 310, which store the retracted tape 110 in the upper housing 102. These reels are held in place by an axel 311 inserted into the axel well 312 on the bottom of the upper housing 301 and an axel well on the inside of the upper housing 102. The tape reels 310 spin freely on the axels 311, although there is a constant force spring in the tape reel 310, applying a force on the reels to draw the tape 110 onto the tape reel 310. This serves the purpose of keeping the tape 110 taut from the device to the reference stakes 112. As the device moves, the tape 110 will move against the tape roller 401, which transmits its motion via axel 313 to the slit wheel 315. Thus, the slit wheel 315 will spin directly proportional to the movement of the tape 110.

Figure 4:
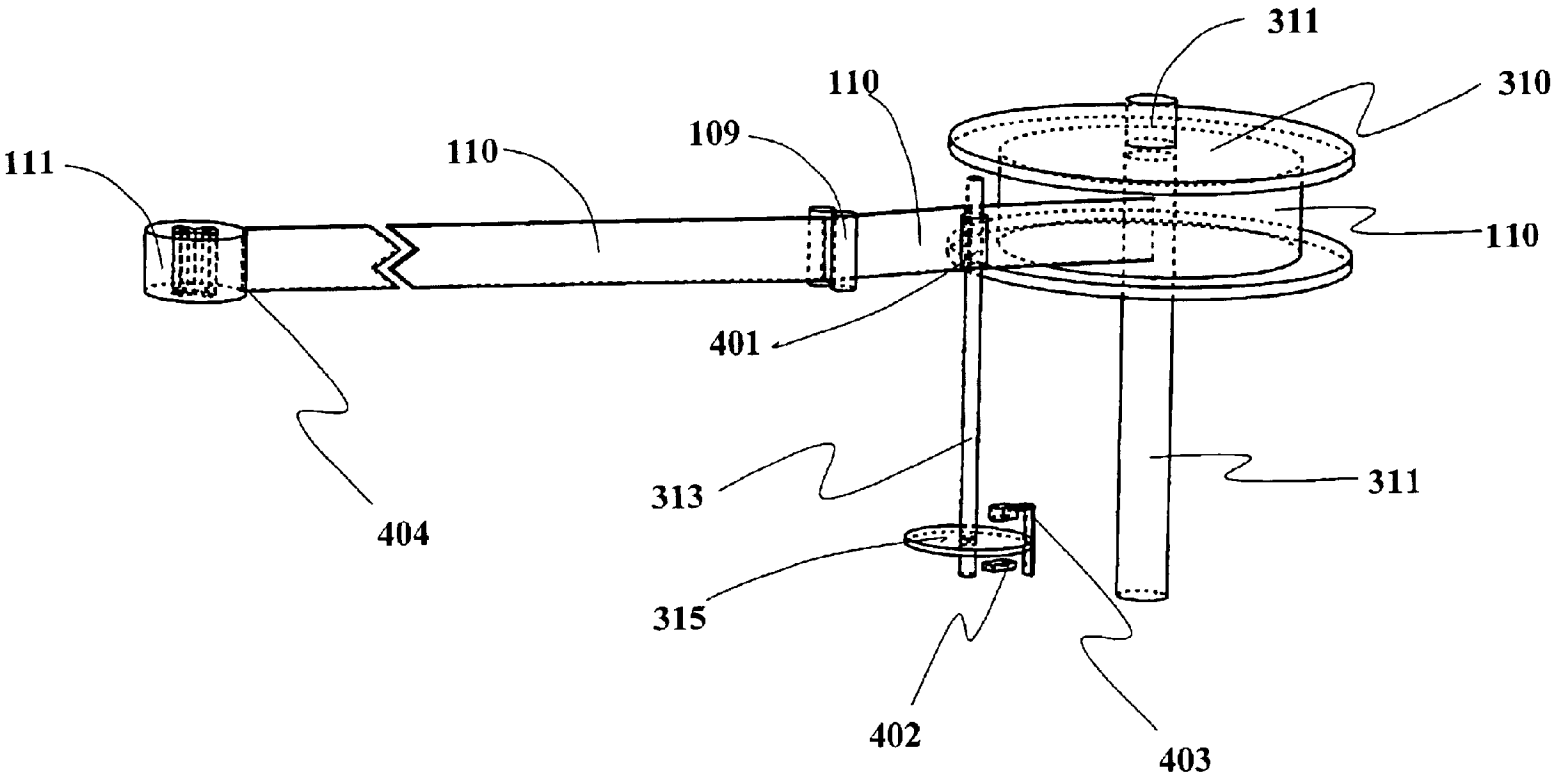
FIG. 4 is a close up view of the positioning component.

FIG. 4 is an expanded view of the tape unit. Each tape unit consists of a tape reel 310, a constant force spring inside of the tape reel 310, and an optomechanical device 402 403 that keeps track of the amount of tape 110 that is extruded. To simplify the position calculations, each pair of the units extrudes the tape 110 between tape guides 109 in the upper housing 102 to prevent binding, and more importantly, to establish an intersection point to control the triangulation point of the tape. This is best seen in the top down view provided by FIG. 5. Note that the pair of tapes 110 intersect 501 at the tape guides 109. Furthermore, note that the point 404 at which the tape 110 is attached to the reference point connector 111 is fixed, so that it does not rotate about the reference stake 112 when attached. With these key elements, in conjunction with knowing the location of the fixed reference points 404 and the amount of tape 110 extruded between the tape guides 109, triangulation is possible. In alternate embodiments, there is nothing prohibiting the tape 110 from extruding from a non-intersecting point from the device. The benefit of triangulation is that the calculations to determine the position of the device are much simpler than calculations for non-triangulating tape configurations. It is also noteworthy that when the device is in use, the tape guides 109 are several inches above the wall, permitting some clearance should door trim, window trim, or other low surface obstructions fall within the confines of the reference stakes 112 that the tapes 110 are attached to.

Optimally, the tape 110 is flat, lightweight, semi-rigid, resistant to stretching, moderate in tensile strength, and is readily cleaned with common cleaners. These characteristics ensure 1) compactness of the tape when fully wound on the reel 310, so that the device is not cumbersome or uncomfortable to hold during use, 2) a minimal amount of sagging when fully extended, 3) trueness in recording the distance the device is from the fixed reference point 404, and 4) easy maintainability, as the tape must be clean of foreign matter.

The constant force spring in the tape reel 310 must provide enough tension to ensure minimal sagging of the tape 110 when fully extended, but not so much as to encumber the free movement of the device over the wall. The characteristics of the tape 110 and the constant force spring must be worked in tandem in order for them to perform optimally.

The optomechanical device translates the analog extension of the tape into a digital form, providing this information to the CPU. The current embodiment of the translation of linear motion of the tape 110 to the circular motion of the slit wheel 315 is performed by tension of the tape 110 against the tape wheel 401. This tension is maintained by forcing the tape 110 out of a straight line between the tape reel 310 and tape guides 109. Should the quality of the linear to circular translation suffer due to insufficient traction (i.e., slippage occurs between the tape 110 and tape wheel 401), then alternatives to reduce the slippage can be implemented, such as adding teeth to the tape 110 and gearing the tape wheel 401 (i.e., rack and pinion) or adding holes to the tape 110 and teeth to the tape wheel 401 (i.e., another form of rack and pinion). A light emitting diode (LED) 403, light sensor 402, and integrated circuit complete the capture of the tape's 110 motion by translating the on-off sequences of light into distance and direction traveled. Other alternatives to ensuring a true reading involve magnetically encoding the tape 110, adding bar codes to the tape 110, or patterned holes through the tape 110, to mark significant distance milestones along the tape 110 for resynchronization purposes. In using tape 110 to implement the positioning component, there is a need for a plurality of extruding tape units, with each pair of units providing sufficient sensor data to triangulate the location of the intersection of the tape 110, which is a fixed location on the device.

It is also noteworthy that should a tape 110 be accidentally extended during use, say the operator's sleeve pulls extra length off the tape reel 310, the triangulation calculations will reveal that the fixed distance between the intersecting points 501 is significantly off. In this case, the device will defer from rendering any pixels till the reported distance between the intersecting points 501 is re-established.

Method of Use

The method of using the device is fairly straightforward. The first step is to design and plan the mural to be rendered onto the wall. The source of the image can be any digital image, such as a digital photograph, a graphic bought commercially or downloaded from the internet, or a graphic prepared via commercially available software, and so on. The operator must take into consideration the resolution of the image, and its eventual size when it is rendered on the wall. Generally speaking, the lower the resolution of the image and the larger it is rendered, the grainer it will appear. This might be satisfactory, as exemplified by mosaics, but must be taken into account. The mural does not have to be restricted to a single graphic either. The mural could be a composite of many smaller images, making up a larger scene or image. In any event, the imagination is the limit.

The next step is to prepare the wall. If there are large expanses of background of a near singular color, then the best course of action is to paint the background area, as opposed to using the device to fill in the background color, thereby saving time and ink. For instance, if there is a great expanse of sky in the mural, with some birds here and there, the best course is to paint the wall sky blue, and use the device to apply the birds. Of course, prior to using the device, the wall must be clean and dry, and porous enough to accept the ink of the device.

The next step involves establishing the fixed reference points 404 associated with the wall to which the image will be applied. The current embodiment involves anchoring the reference stakes 112 into the wall. This is somewhat destructive, as it will leave small holes near the corners of the mural, so one alternative is to have an extendable pole, with the reference stakes 112 attached to the pole. This pole, for instance, can be positioned in the corner of the room, and extended to clamp tightly between the floor and ceiling, providing reference stakes 112 without putting small holes in the wall.

Note that the reference stakes 112 do not necessarily have to be anchored to the surface accepting the image. For instance, if the device is being used to apply a mural to a tabletop, rather than anchoring the reference stakes 112 into the table, a wooden frame can be clamped along the edges of the table, and the reference stakes 112 anchored to the frame, saving the table from marring. The bottom line is that as long as the reference stakes 112 are fixed relative to the surface accepting the image, the device will have a means of identifying an absolute position on the surface, necessary to impart an image.

Once the fixed reference points are set, the operator must attach the reference point connectors 111, which are attached to the extruding tape 110, to the head of the reference stakes 112.

The next step is to establish the distance and location of the fixed reference points 404. It is not enough for the device to be attached to the reference stakes 112, even if the embodiment of the extruding tapes 110 could report the precise distance the device is away from each reference point 404 as soon as the tapes 110 are attached to the reference stakes 112. Without knowing the distance 502 each reference point 404 is from each other, the triangulation calculation is impossible. Thus, the operator, through guidance provided via the LCD 114, must alternately move the device to each reference point 404, and in the current embodiment, press the trigger 104 when abutting the reference point connector 111. Another embodiment of this, rather than requiring the operator to press the trigger 104, is to sense the abutting automatically, say by making the reference point connector 111 of a conducting material, and sensing the completion of a circuit through the tape guides 109. In any case, this operation of moving to every reference point 404 establishes the zero tape length for each abutting reference point 404, and simultaneously provides the absolute distance 502 between the other reference points 404. With this information, triangulation is now possible.

It is worth noting that the distance between the plurality of tape intersections 501 extruding from the tape guides 109 are fixed and known. This being the case, should any of the extruding tapes 110 report an erroneous distance, the calculation of the fixed distance between the sets of tape guides 109 will be out of tolerance, and recalibration will be required if the condition persists. For instance, if the operator's sleeve is caught on one of the tapes 110, providing a false measurement, this condition will be caught by comparing the calculated distance between the tape intersections 501 against the known distance between the tape intersections 501, and the device will not print any portion of the image. As soon as the operator allows the tape 110 to return to its taut position, the device will again calculate valid positions, and printing will be allowed.

The digital image can now be loaded or "printed" to the device via a computer. Future embodiments could allow images to be loaded via cartridges or memory sticks, such as those employed by digital cameras. At this point, the image will be stored in the RAM of the device, ready to be applied to the wall. Note that in addition to the image itself, there are also defined points on the image, dubbed "image points", which are critical in placing the image onto the wall.

Before the operator can begin applying the image to the wall, they must identify where on the wall the image is to go. This involves the operator identifying the image points on the wall. The LCD 114 will guide the operator through the image points that need to be defined, and the operator will define them by aligning the pin site 116 with the desired location on the wall, and pressing the trigger 104. For instance, an image of a leaf might only be defined with three points, one of which is the base of the stem. The operator, wishing to "attach" the leaf to an image of a vine on the wall, simply identifies the stem image point on top of the vine, and sizes the leaf with the other two image points. With this technique, a single image can be used over and over to create a more complex image. As a final note on image points, they can also be used to skew the image to add perspective, or produce a mirror image, or just add an interesting twist on the image.

Figure 6:
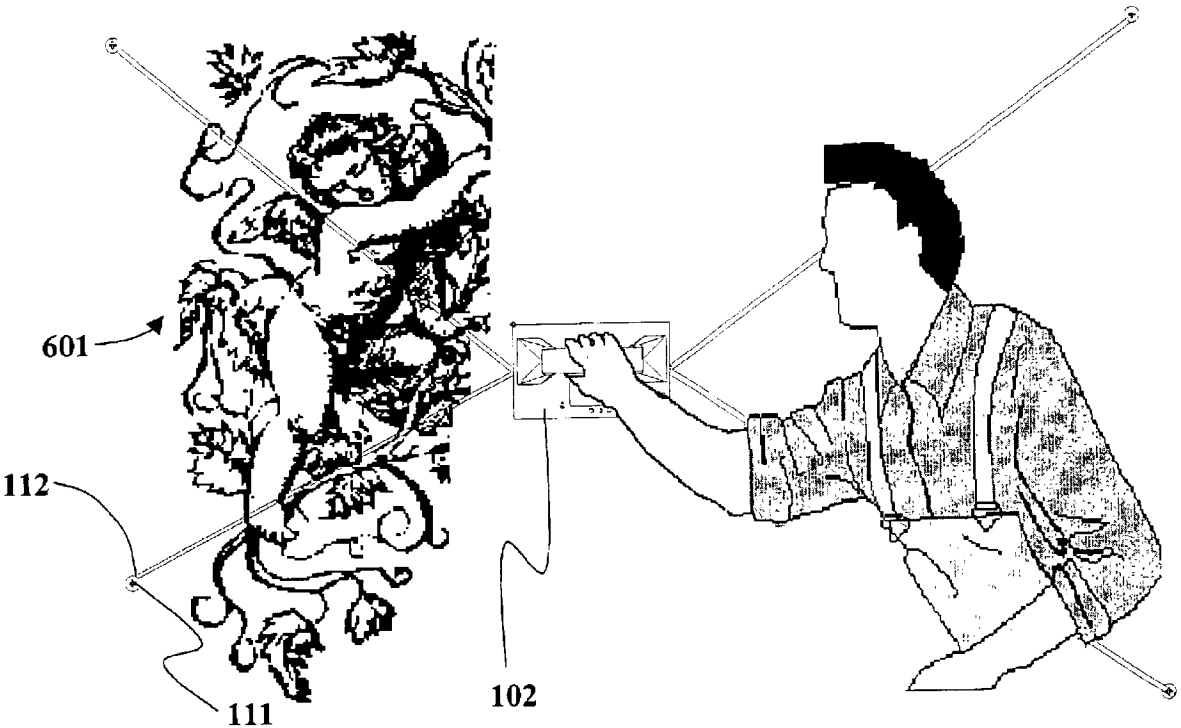
FIG. 6 illustrates the device in use.

Once the image is loaded and the image points defined on the wall, the operator is ready to apply the image. This is done via sweeping motions in the direction of the rollers 105 on the lower housing 103, while holding down the trigger 104. FIG. 6 shows the device in use by an operator, who has swept a portion of the image 601 already. To be productive, the sweeping motions obviously must occur over the area on the wall where the image points have been defined. As the device is moved across the surface, it determines which pixels of the image are to be rendered on the wall based on the defined image points of the image and the location of the device over the wall at any given instant. Once the pixels have been rendered, they are marked as being "printed", and should the operator sweep across the same area of the wall again, the pixels will not be rendered again. If the operator is looking to get into a tight inner corner or edge of the wall, the lower housing 103 can be spun, allowing the print element array 201 to get as close as possible. In these instances, the device will sense that the lower housing 103 has been moved a specific increment of ninety degrees, and adjust the rendering calculations accordingly. If the operator is unsure of the final look of the image, a transparency or paper can be attached to the wall with a nondestructive adhesive, and the image rendered to this attached medium, thereby giving the operator a preview. Once the operator is satisfied, the transparency or paper can be removed, and the operation of printing the image can be repeated to the wall itself.

I claim as my invention:

1. A hand held device that renders a digital image to a wall, ceiling, floor, or any smooth relatively flat surface, said device comprising:

a. A communications port that accepts a digital image from an external source, said image to be rendered on said surface;

b. A plurality of extruding and retracting tapes, whereby each said tape:

i. Is associated with a single fixed reference point on said surface and a single fixed reference point on said device;

ii. Extrudes and retracts relative to the movement of said device and kept taunt via a constant force mechanism; and iii. The extrusion and retraction of which is translated via an optomechanical sensor into the instantaneous distance between said fixed reference points.

c. An array of print head elements that impart coloration on said surface;

d. A computational unit that executes system software, whereby said software:

i. Accepts said digital image via said communications port;

ii. Maps said digital image to said surface;

iii. Uses said distances reported by plurality of said optomechanical sensors to determine the absolute position of said print head elements with respect to the surface; and iv. Directs said print head elements to render the corresponding pixels of said image mapped to said surface.

2. A hand held device as in claim 1, wherein said communications port consists of a non-cable link, such as an optical, acoustic, radio frequency link, or a memory cartridge.

3. A hand held device as in claim 2, wherein said communications port consists of infrared communications.

4. A hand held device as in claim 1, wherein the print head elements consist of ink jet nozzles.

5. A hand held device as in claim 1, wherein each extruding and retracting tape distance sensor consists of:

a. Tapes of sufficient length, housed on a tape reel by a constant force spring;

b. A friction or geared axle that via contact with said tape, converts the linear motion of said tape into circular motion of said axle;

c. A wheel, attached to said axle, that has a plurality of slits permitting light from a light emitting diode to shine through to a light sensor to capture the circular motion of said wheel; and d. Circuitry to translate the count of said slits into the instantaneous travel distance of said extruding and retracting tape.

6. A hand held device as in claim 1, wherein the computational unit consists of a Central Processing Unit (CPU), Read Only Memory (ROM), optional Erasable Programmable Read Only Memory (EPROM), and Random Access Memory (RAM).

7. A hand held device as in claim 6, wherein system software is stored in said ROM and/or said EPROM, running on said CPU with the assistance of said RAM providing the following methods:

a. Accepts said digital image into said RAM through said communications port;

b. Triangulates said plurality of distances reported by each said optomechanical sensor based on said extrusion and retraction of each tape, in order to establish a two dimensional virtual absolute coordinate system relative to said surface, thereby determining the position and orientation of said print head elements with respect to said surface; and c. Based on said absolute position of said device on said surface, imparts coloration on said surface corresponding to pixels of said image, flagging pixels in said memory so that they are no longer imparted.

8. A hand held device as in claim 1, wherein a site pin, that in conjunction with the virtual absolute coordinate system established by said plurality of extruding and retracting tapes, allows the identification of the placement of said image on said surface.

9. A hand held device as in claim 1, wherein a display unit and menu selection provides means for said device to solicit operator input.

10. A hand held device as in claim 9, wherein said display unit consists of a liquid crystal display (LCD) and said menu selection consists of a plurality of buttons.

11. A method of rendering a digital image to a wall, ceiling, floor, or any smooth relatively flat surface, the method comprising:

a. As part of the initial setup:

i. Affixing a plurality of reference stakes relative to said surface;

ii. Attaching said device via plurality of said extruding and retracting tape to said fixed reference stakes;

iii. Sequentially moving said device to each fixed reference stake to establish the constant distances between the fixed reference stakes, thereby ensuring sufficient information to perform triangulation;

b. Then, for each image desired:

i. Loading an image into said RAM via said communications port;

ii. Identifying the location on said surface, via a site pin, where said image is to be rendered through the use of critical image points; and iii. Repeated sweeping movement of said device over said surface where said image is to be rendered.

* * * * *